US006722960B2

(12) United States Patent
Brooks

(10) Patent No.: US 6,722,960 B2
(45) Date of Patent: Apr. 20, 2004

(54) APPARATUS FOR PLANING AND SIZING A WORKPIECE

(75) Inventor: Gene R. Brooks, Rogersville, TN (US)

(73) Assignee: Cemco, Inc, Whitesburg, TN (US)

( * ) Notice: Subject to any disclaimer, the term of this patent is extended or adjusted under 35 U.S.C. 154(b) by 41 days.

(21) Appl. No.: 10/233,169

(22) Filed: Aug. 30, 2002

(65) Prior Publication Data

US 2004/0040623 A1 Mar. 4, 2004

(51) Int. Cl.[7] ..... B24B 7/00; B24B 9/00; B27M 1/08; B27C 9/00

(52) U.S. Cl. ..... 451/65; 29/28; 29/33 R; 144/3.1; 144/38; 144/136.1; 144/245.2; 144/242.1; 144/369; 451/302

(58) Field of Search ..... 29/26 A, 26 C, 29/560, 28, 33 R, 30; 144/1.1, 3.1, 114.1, 38, 117.1, 242.1, 245.1, 245.2, 367, 369, 371, 136.1; 451/39, 65, 300, 301, 424

(56) References Cited

U.S. PATENT DOCUMENTS 3,627,000 A * 12/1971 Alden
4,178,721 A * 12/1979 Evans
4,323,099 A * 4/1982 Bost ..... 144/3.1
4,471,822 A * 9/1984 Griganavicius ..... 144/3.1
4,724,877 A * 2/1988 Culley, Jr. ..... 144/116
4,938,111 A * 7/1990 Massé ..... 83/425.3
5,733,180 A * 3/1998 Kilde ..... 451/65
5,865,228 A * 2/1999 Patterson ..... 144/1.1
5,882,157 A * 3/1999 Buysman et al. ..... 144/117.1 X
6,086,461 A * 7/2000 Williams et al. ..... 451/65
6,405,769 B1 * 6/2002 Labrie ..... 144/3.1

* cited by examiner

*Primary Examiner*—W. Donald Bray
(74) *Attorney, Agent, or Firm*—Smith, Gambrell & Russell

(57) ABSTRACT

An apparatus for sizing and sanding a workpiece, the apparatus comprising a housing having a horizontally throughgoing passage, a feed conveyor for advancing the workpiece through the passage, the workpiece having an upper surface that advances through the passage along a pass line, a sanding station for finishing the upper surface, and a planing station for sizing the workpiece along the upper surface. The planing station of the present invention has a driven planer head, an antikickback assembly, a chip-break assembly, and means for disengaging the planing station to convert the apparatus from a planing and sanding configuration to a sanding-only configuration.

27 Claims, 4 Drawing Sheets

APPARATUS FOR PLANING AND SIZING A WORKPIECE

BACKGROUND OF THE INVENTION

The present invention relates to the field of processing lumber and more particularly to the art of planing a surface of workpiece to a desired thickness, and sanding the planed surface of the workpiece to finish its surface. With even more particularity, the present invention relates to a combination planer and sander machine that may be operated in either a planing and sanding configuration or a sanding-only configuration.

Planers and sanders are well known in the art and their function in shaping wood to a desired thickness is well known. Combination planers and sanders are used to both size and finish workpieces. These machines have a planing station comprising at least one driven planer head that is used to size workpieces to a predetermined thickness, and also a sanding station that typically includes at least one driven sander head that is used to finish the planed surface of the workpiece. Conveyors are utilized to feed workpieces through a planer and sander along a feed path and in a feed direction.

Combination planers and sanders have several safety features, including antikickback fingers and chip-break shoes that ride over the upper surface of the workpiece prior to planing. Antikickback fingers prevent a workpiece from moving through a sander and planer in a direction opposite the feed direction, which can be caused by the blades of a rotating planer head digging into the surface of a workpiece and driving it backwards, instead of planing the surface of a workpiece as it proceeds along a feed path in the feed direction. The distal end of antikickback fingers ride along the surface of the workpiece as the workpiece travels in a feed direction. In the event a workpiece is driven backwards, the forward edge of the antikickback fingers dig into the upper surface of the workpiece and the antikickback fingers rotate about a holding bar in direction tangentially opposite the feed direction until such rotation is halted by a stop member. In this manner, the antikickback fingers halt the backward motion of a workpiece and prevent it from backing out of the machine at its inlet.

Chip-break shoes, another safety device in combination planers and sanders, prevent significant damage to the quality of a workpiece resulting from chipping along a woodgrain by operation of the planer head. The distal ends of chip-break shoes ride along the surface of the workpiece, and if the planer head should cause a chip to form along a woodgrain, such formation would result in a lifting of the upper surface of the workpiece. Without a chip-break shoe, the formation of the chip would be allowed to continue unimpeded potentially deep into the workpiece, thereby risking significant damage to the workpiece. The chip-break shoes prevent the upward movement of the surface of the workpiece, causing the chip to break off at the forward end of the chip-break shoes. Because the chip-break shoes are positioned proximate the planer head, chips are broken off by the chip-break shoes almost immediately upon formation and significant damage to the workpiece is thereby prevented.

Normally a planer and sander machine is utilized for both sizing and finishing workpieces, that is, it is used in its normal configuration for both planing and sanding. In some instances it is desirable to only sand/finish workpieces and not to also plane/size workpieces. For instance, operation of a sanding-only configuration is often desirable for veneered parts and cabinet doors with stiles and rails. To place a machine in a sanding-only configuration, the planer head must be adjusted vertically so that it is above the sanding passline, in which case the planer head will not contact the workpiece. However, utilizing the planer and sander in this configuration can cause damage to the workpiece on account of the operation of the antikickback fingers and chip-break shoes, which ride long the upper surface of the workpiece. Practice has demonstrated that antikickback fingers and chip-break shoes will scratch the stiles of a door and any veneered surface, and the scratches will often be deeper than the amount of stock being subsequently removed by the sanding station. Thus, for those workpieces for which processing in a sanding-only configuration is desired, operating a planer and sander with the antikickback fingers and chip-break shoes engaging the surface of the workpiece significantly degrades the quality of the finished product.

To operate a planer and sander in a sanding-only configuration, it is necessary to either remove the antikickback fingers and chip-break shoes from the machines altogether or to otherwise move them so that the antikickback fingers and chip-break shoes do not engage a workpiece as it is being processed. Conventional methods of converting a planer and sander from a planing and sanding configuration to a sanding-only configuration are time consuming and difficult, thereby placing significant limitations on the capacity of planer and sander machines to conduct both planing and sanding operations and sanding-only operations.

What is needed is an improved apparatus for sizing and finishing a workpiece that is easy to use, inexpensive to maintain, and allows for readily changing the operation of the apparatus from a planing and sanding configuration to sanding-only configuration. A need exists for an improved planer and sander machine that will greatly speed up the change-over time required to change the configuration of the machine.

SUMMARY OF THE PRESENT INVENTION

It is an object of the present invention to provide an improved combination planer and sander machine.

A further object of the present invention is to provide a combination planer and sander machine that can be easily and quickly converted from a planing and sanding configuration to a sanding-only configuration.

Another object of the present invention is to provide an apparatus for sizing and finishing workpieces that has a sizing station and a planing station having a means for disengaging the planing station to convert the apparatus from a planing and sanding configuration to a sanding-only configuration.

Another object of the present invention is to provide an apparatus for sizing and finishing workpieces having a planing station comprising an antikickback assembly and a chip-break assembly, and means for automatically raising the lowermost portion of the antikickback assembly and chip-break assembly so that the assemblies do not engage a workpiece.

These and other objects of the present invention are accomplished through the use of a combination planer and sander machine for sizing and sanding solid workpieces. The machine has a housing defining a horizontally throughgoing passage extending along a feed path, and a driven feed conveyor onto which a workpiece is fed through the machine along a feed path. The feed conveyor carries the workpiece through the machine along a horizontal feed path, the upper surface of the workpiece passing through the machine along a pass line.

The invention further comprises a planing station that sizes a workpiece along its upper surface and a sanding station that finishes the surface of the workpiece after it has been planed. The planing station of the present invention comprises a planer head, an antikickback assembly, chip-break assembly, and means for disengaging the planing station to convert the apparatus from a planing and sanding configuration to a sanding-only configuration.

The antikickback assembly comprises a plurality of antikickback fingers extending downward from a positioning rod to form a row of antikickback fingers. Each antikickback finger has a lower end terminating in a forward edge. Each antikickback finger is rotatably mounted on the positioning rod and positioned to rest against a cam shaft assembly that acts as a stop limiting rearward motion of the antikickback fingers. Means for disengaging the planing station comprises positioning means for automatically raising the lowermost portion of the antikickback assembly above the passline B. The present invention provides for rotating the cam shaft assembly to raise the lowermost portion of the antikickback assembly, which is accomplished by activating an air operated cylinder or similar actuator having a piston rod pivotally connected at its distal end to a link member connected to the cam shaft assembly. The movement of the piston rod causes the cam shaft assembly to rotate about its longitudinal axis, with the concomitant pivotal movement of the antikickback fingers about the positioning rod so that the lowermost end of the antikickback fingers are positioned above the pass line B.

The chip-break assembly comprises a plurality of chip-break shoes extending from a horizontal holding bar to a distal end terminating in a sharp edge at the forward-most portion of the chip-break shoes. The chip-break shoes are positioned in close side-by side-relationship to form a row of chip-break shoes, each shoe having an essentially continuous upper lower, and bottom surfaces transverse of the direction of the feed path. The holding bar is attached at its ends to the distal end of bracket members that are pivotally connected at the proximal ends thereof to the housing. Means for disengaging the chip-break assembly comprise positioning means for lifting the lowermost portion of the chip-break shoes above the pass line B, which is accomplished by lifting the distal end of the bracket members that support the holding bar proximate the holding bar and chip-break shoes, so that the bracket members rotate about the pivot point being its point of connection to the housing. Lifting the distal end of the bracket members is accomplished by activating an air operated cylinder, or similar actuator, connected to the housing, having a piston rod fixedly connected at its distal end to the bracket members. Retracting the piston rod lifts the lowermost portion of the chip-break shoes above the pass line B.

The present invention further comprises an electrical control means comprising at least one switch for initiating the concomitant operation of the means for automatically raising the lowermost portion of the antikickback assembly above the passline B, the means for automatically lifting the lowermost portion of the chip-break assembly above the passline B, and means for automatically disabling the motive force to the driven planer head. The electrical control means allows the combination planer and sander machine to be readily switched from a planing and sanding configuration to a sanding-only configuration, whereby a workpiece is finished by the sanding station without being sized by the planing station or being engaged by the antikickback or chip-break assemblies.

These and other objects and advantages of the invention will become apparent from the following detailed description of the preferred embodiment of the invention.

BRIEF DESCRIPTION OF THE DRAWINGS

An apparatus for sizing and finishing a workpiece embodying the features of the present invention is depicted in the accompanying drawings which form a portion of this disclosure and wherein.

DESCRIPTION OF THE PREFERRED EMBODIMENT

Figure 1:
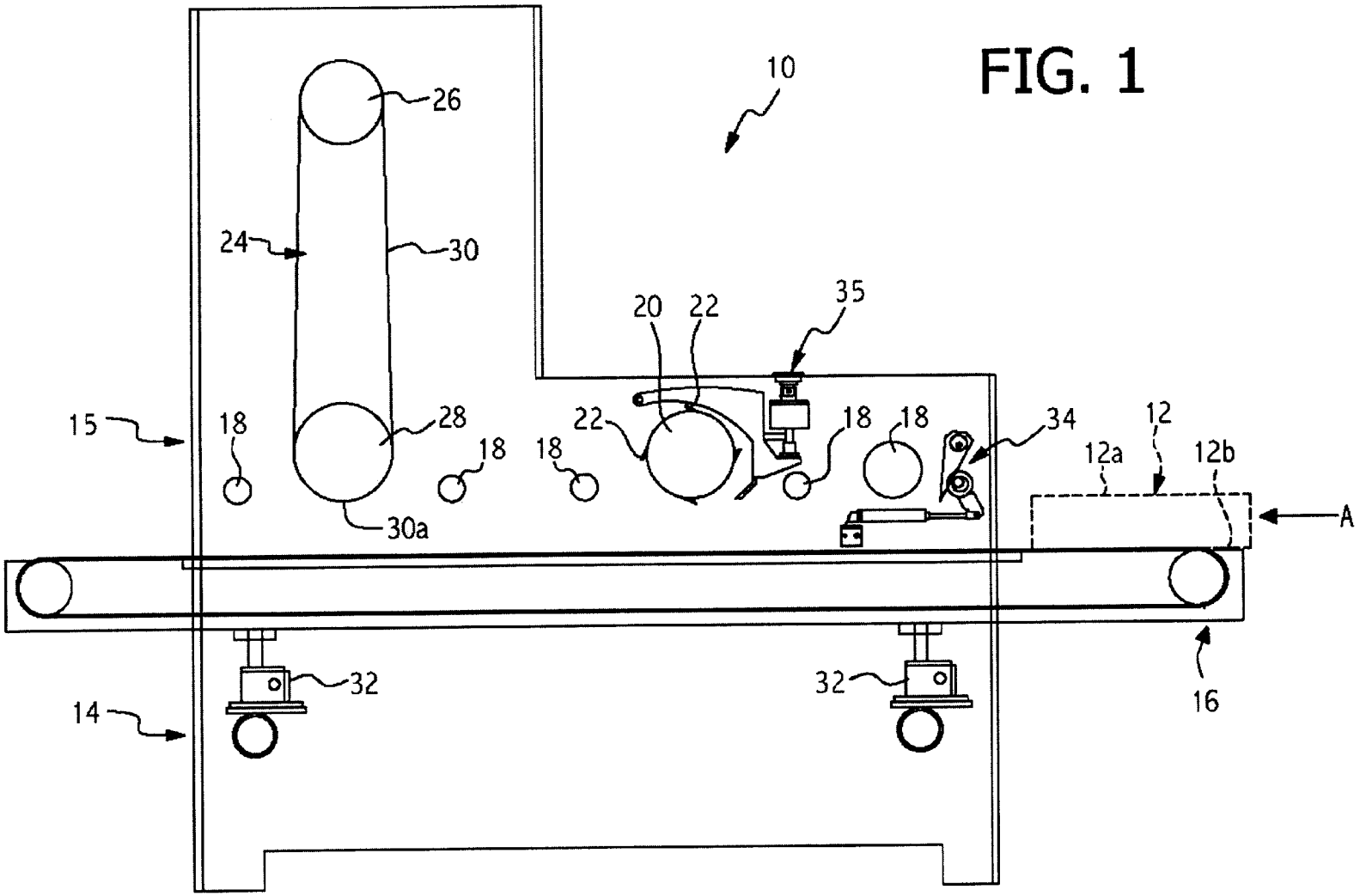
FIG. 1 is a side sectional view of the preferred embodiment of the present invention.

Referring to the FIGS. 1–4 for a clearer understanding of the invention, it may be seen that the preferred embodiment of the invention contemplates a combination planer and sander machine 10 for sizing and sanding solid wood stock or parts. The machine 10 has a housing with a lower frame assembly 14 and an upper frame assembly 15 together defining a horizontally throughgoing passage extending along a feed path. The lower assembly 14 is provided with a feed conveyor 16 onto which a workpiece 12 such as wood stock is fed through the machine 10 along a feed path in the direction indicated by arrow A. The feed conveyor 16 is driven for rotation by a motor, not shown, and carries the workpiece 12 through the machine 10 along a horizontal feed path defined on its lower side by the upper surface of the feed conveyor 16 and its upper side by the upper surface 12*a* of the workpiece which passes through the machine 10 along a pass line shown on FIGS. 2 and 3 by the line B.

In the preferred embodiment, the upper surface of the workpiece 12*a* is engaged by a plurality of hold down rolls 18 that urge the bottom surface of the workpiece 12*b* against the upper surface of the feed conveyor 16 as it travels along a feed path through the machine 10. The hold down rolls 18 are carried on and rotate about shafts centered on a horizontal longitudinal axis that extends perpendicular to the direction indicated by the arrow A. In the preferred embodiment the hold down rolls 18 are not driven, although it is contemplated that in the present invention one or more such hold down rolls 18 could be driven to help urge the workpiece 12 through the machine 10. As the workpiece 12 moves through the machine, the upper surface 12*a* of the workpiece engages a planing station that that sizes the workpiece 12 to a predetermined thickness. The planing station comprises a planer head 20 that rotates about a driven shaft which is centered, similar to the hold down rolls 18, on a horizontal longitudinal axis that extends perpendicular to the direction indicated by the arrow A. The planer head 20 comprises a plurality of planer blades 22, extending radially therefrom, which plane the upper surface 12*a* of the workpiece. The vertical position of the planer head 20 of the preferred embodiment is manually adjustable to set the amount that a workpiece 12 is planed.

After planing, the upper surface 12*a* of the workpiece subsequently engages a sanding station having at least one driven sander assembly 24 that finishes the upper surface of the workpiece. Driven sander assemblies 24 such as utilized with the present invention are well known in the art. In the preferred embodiment, the sander assembly 24 comprises an upper sanding roller 26 and a lower sanding roller, or sanding head 28, and an endless sanding belt 30 having an outer sanding surface 30*a*. One or both of the lower sanding roller and sanding head 26, 28 are driven by a motor, not shown. The upper surface 12*a* of the workpiece engages the outer surface 30*a* of the sanding belt proximate the lowermost point of the sanding head 28. The driven sander assembly 24 is manually adjustable vertically to control the finishing of the upper surface 12*a* of the workpiece. To further control the amount that a workpiece 12 is sized and sanded, and to allow the machine 10 to be utilized for workpieces 12 of various thicknesses, the vertical position of the feed conveyor 16 may be adjusted. The lower frame assembly 14 further comprises at least two conveyor jack assemblies 32 that are used to raise and lower the feed conveyor 16.

As shown on FIG. 1, a workpiece 12 engages the planer head 20 prior to engaging the sanding head 28. This allows for finishing the upper surface 12*a* of the workpiece after it has been planed. Traveling along a feed path for a workpiece 12 and preceding the planer head 20, the planing station of the present invention further comprises an antikickback assembly 34 and a chip-break assembly 35. The antikickback assembly 34 precedes the planer head 20 and prevents the planer head 20 from driving workpieces 12 backward along the feed path, that is, in an direction opposite to the feed direction shown by the letter A. The antikickback assembly 34 prevents the planer head 20 from driving workpieces 12 back out of the machine 10. The chip-break assembly 35 precedes the planer head 20 and prevents the planer head 20 from chipping the workpiece 12 along a grainline past the distal end of the chip-break assembly 35.

Figure 2:
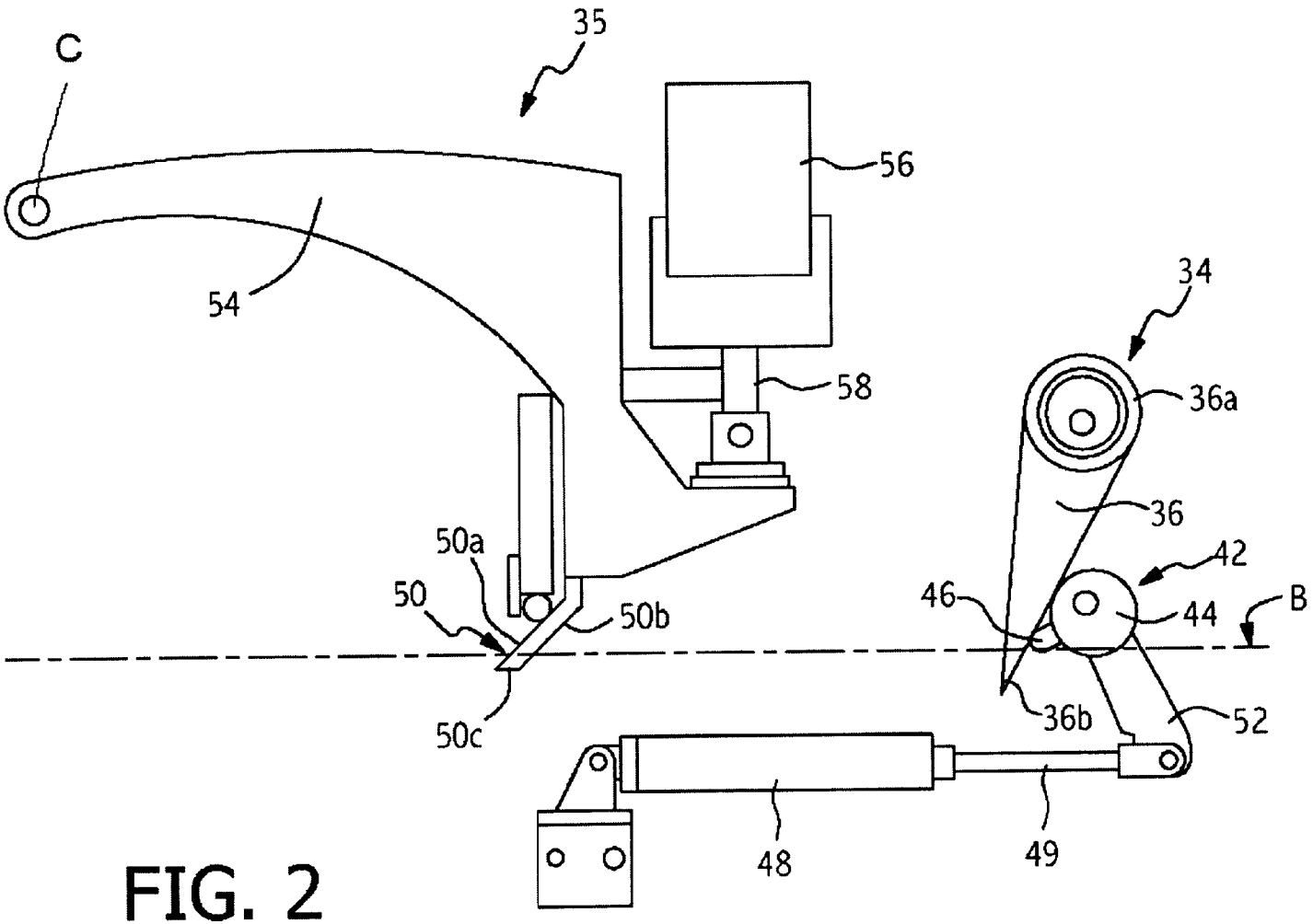
FIG. 2 is a side sectional view of the antikickback assembly and chip-break assembly of the present invention, the antikickback assembly and chip-break assembly being in an engaged position.
Figure 3:
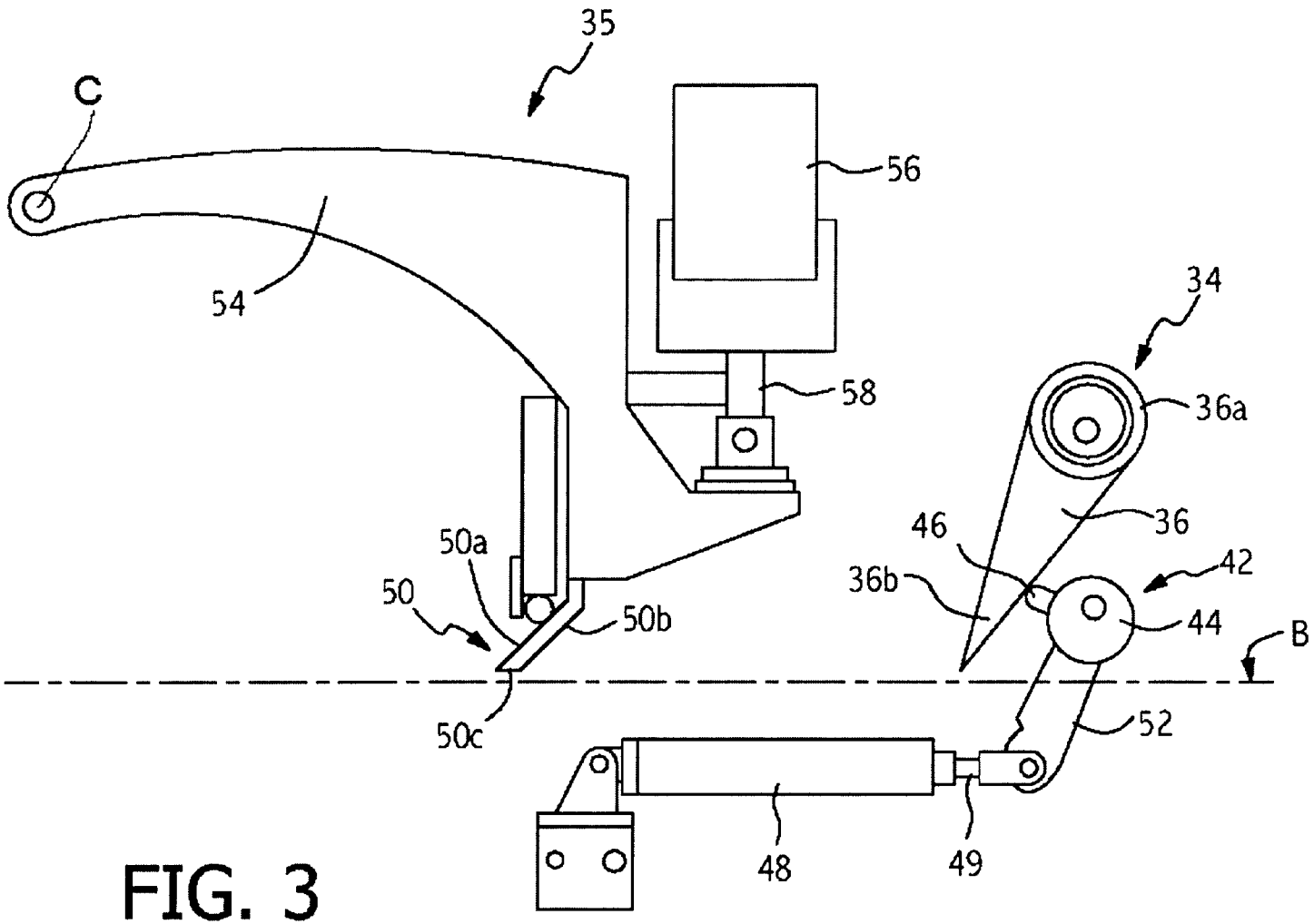
FIG. 3 is a side sectional view of the antikickback assembly and chip-break assembly of the present invention, the antikickback assembly and chip-break assembly being in a disengaged position.

It can be appreciated with reference to FIGS. 2 and 3 that the upper surface 12*a* of a workpiece to be sized and shaped in the machine 10 defines a passline depicted by the line B on FIGS. 2 and 3. The passline B shown on FIGS. 2 and 3 precede sizing of the workpiece 12 by the planer head 20, so the passline B represents the distance above the upper surface of the feed conveyor 16 defined by the thickness of the unprocessed workpiece 12. As will be further described, to operate the antikickback assembly 34 and chip-break assembly 35, the lowermost portions of these assemblies 34, 35 must be positioned below the passline B so that a portion of these assemblies contacts the upper surface 12*a* of a workpiece as it passes through the machine 10. The antikickback assembly 34 and chip-break assembly 35 may be disengaged by raising lowermost portion of the assemblies 34, 35 above the passline B, so that the assemblies are no longer in contacting engagement with the workpiece 12. The planer head 20 may be disengaged by means of raising it above the passline B so that it does not engage a workpiece 12 and by means of disabling the motive force that drives the planer head 20 so that it does not rotate about its horizontal axis. A workpiece 12 passing through the machine 10 with the antikickback assembly 34, chip-break assembly 35, and planer head 20 in a disengaged positioned would not contact the assemblies 34, 35 or planer head 20 prior to reaching the sanding assembly 24. This describes a sanding-only configuration caused by disengaging the planer head 20 and preceding antikickback and chip-break mechanisms associated with operation of the planer head 20, allowing a workpiece 12 to be finished by the sanding assembly 24 without also being sized by the planer head 20.

Figure 4:
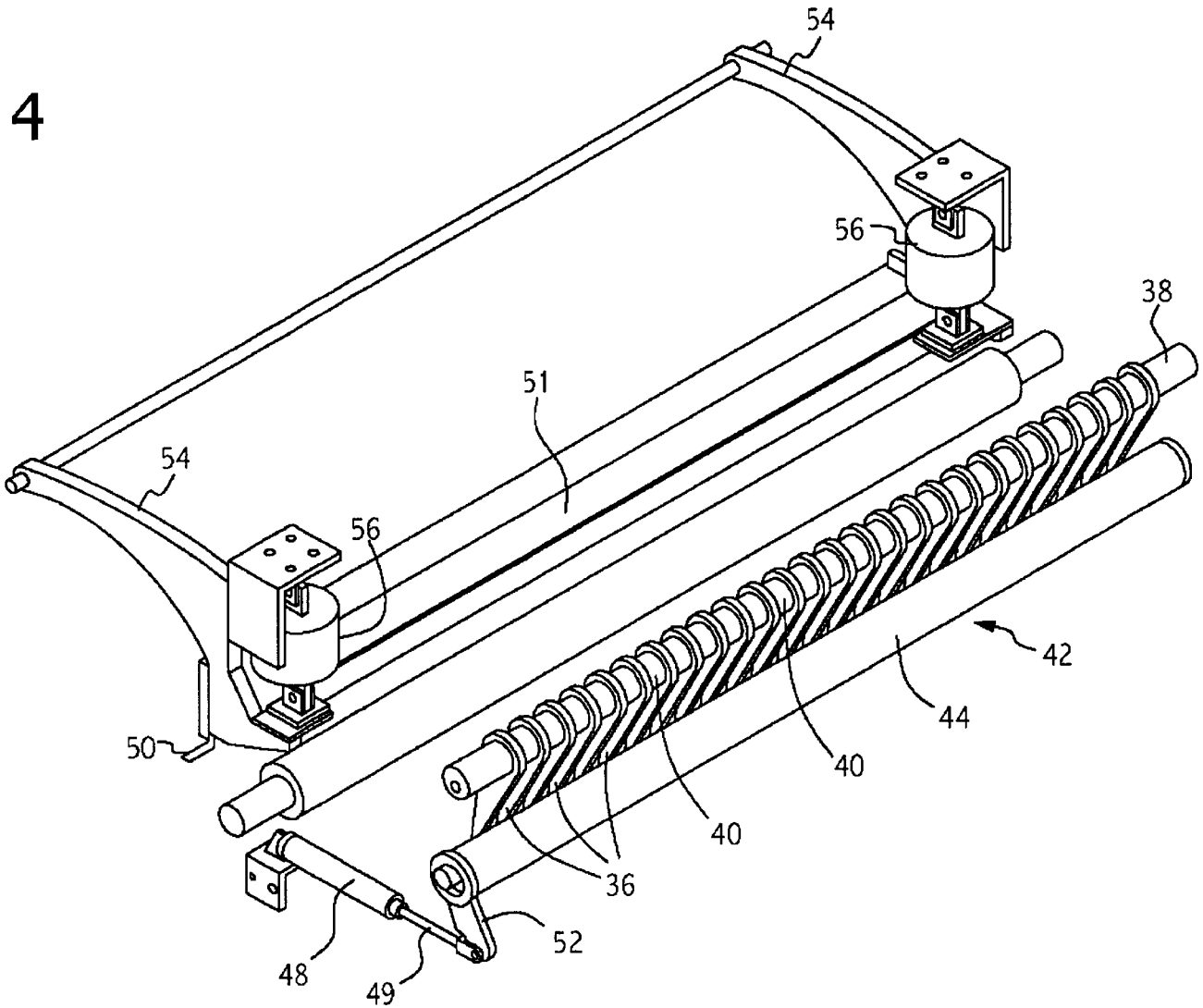
FIG. 4 is a perspective view of the antikickback assembly and chip-break assembly of the present invention.

With reference to FIGS. 2–4, the preferred embodiment of the present invention has an antikickback assembly 34 comprising a plurality of antikickback fingers 36 positioned equidistant along a horizontal positioning rod 38 to form a row of antikickback fingers 36. Each antikickback finger 36 is a generally tear-shaped plate having an opening formed in its larger upper end 36*a* through which the horizontal positioning rod 38 passes. The lower end 36*b* of each antikickback finger 36 extends downward from the positioning rod 38 and terminates in a pointed edge. Between the antikickback fingers 36 along the positioning rod 38 are cylindrical spacers 40. Positioned below the positioning rod 38 is a cam shaft assembly 42 that acts as a stop for the antikickback fingers 36. The cam shaft 42 limits the rearward motion of the antikickback fingers 36. Each antikickback finger 36 is biased against the cam shaft assembly 42 by means of gravity, so that the rearward edge 36*c* of the antikickback finger rests on the cam shaft assembly 42 as shown in FIG. 4. When a workpiece 12 passes under the antikickback finger 36, the finger rises off of the cam shaft assembly 42 and the lower end 36*b* of the antikickback finger rides along the upper surface 12*a* of the workpiece. Each antikickback finger 36 is free to move independently to account for variations in the shape of the workpiece 12. If a workpiece 12 should reverse direction, the pointed edge of the lower end 36*b* of the antikickback fingers dig into the workpiece 12 until the cam shaft assembly 42 halts the rearward motion of the antikickback fingers 36. In this manner, the antikickback assembly 34 prevents workpieces 12 from being driven back out of the machine 10.

The antikickback assembly 34 is disengaged by raising the lowermost portion of the antikickback fingers 36 above the pass line B, so that a workpiece passing under the antikickback assembly 34 is not in contacting engagement with the antikickback fingers 36. In the present invention the planer station further comprises means for disengaging the antikickback assembly 34 comprising positioning means for automatically raising the lowermost portion of the antikickback assembly 34 above the passline B. In the preferred embodiment, this is accomplished by means of rotating the cam shaft assembly 42 about its longitudinal axis, the cam shaft assembly 42 being rotatably mounted to the housing. As shown in FIGS. 2 and 3, the cam shaft assembly is comprised of a primary cylindrical shaft 44 and a cam lobe 46 extending along its length. In the engaged configuration shown on FIG. 2, the rearward edge 36*c* of the antikickback fingers rests against the primary shaft 44 with at least a portion of the antikickback finger 36 extending below the pass line B. Rotating the cam shaft assembly 42 in a clockwise direction causes the antikickback fingers 36 to rest against the secondary shaft 46 resulting in the antikickback fingers 36 being raised above the pass line B. This places the antikickback assembly 34 in a disengaged position as shown on FIG. 3. Rotation of the cam shaft assembly 42 is accomplished by activating an air operated cylinder 48 or similar actuator, mounted horizontally in the preferred embodiment, having a horizontal piston rod 49 pivotally connected at its distal end to a link member 52 attached to the primary shaft 44. With the antikickback assembly 34 in an engaged position as shown in FIG. 2, the horizontal piston rod 49 is in an extended position. This is the sanding and planing configuration of the machine 10. In contrast, FIG. 3 shows the antikickback assembly 34 in the disengaged position, wherein the horizontal piston rod 49 is in a retracted position. The movement of the horizontal piston rod 49 from an extended to retracted position caused the cam shaft assembly 44 to rotate in a clockwise direction about its longitudinal axis, with the concomitant pivotal movement of the antikickback fingers 36 about the positioning rod 38 so that the lowermost end 36*b* of the antikickback fingers are positioned above the pass line B. This is the sanding-only configuration of the machine 10.

The preferred embodiment of the present invention has a chip-break assembly 35 comprising a plurality of chip-break shoes 50 that extend from a horizontal holding bar 51, terminating in a distal end positioned below and forward the holding bar 51. The chip-break shoes 50 are positioned in close side-by side-relationship to form an essentially continuous upper 50*a*, lower 50*b*, and bottom surfaces 50*c* transverse the direction of the feed path. The upper 50*a* and bottom 50*c* surfaces of the chip-break shoes join a sharp edge at its forward-most portion proximal planer head 20, as shown in FIGS. 2 and 3. When a workpiece 12 passes under the chip-break shoe 50, the shoe rides along the surface 12*a* of the workpiece along its bottom surface 50*c*. If the planer head 20 should cause a portion of a workpiece 12 to chip along a grain, the upper surface 12*a* of the workpiece would begin to rise proximate the sharp edge of the chip-break shoe 50. In this event, the sharp edge of the chip-break shoe 50 acts as a stop against upward movement of the chip, causing the chip to break at the forward-most portion of the chip-break shoe 50.

The chip-break assembly 35 is disengaged by raising the lowermost portion of the chip-break shoes above the pass line B, so that a workpiece passing under the chip-break assembly 35 is not in contacting engagement with the chip-break shoes 50. The planing station of the present invention further comprises positioning means for automatically lifting the chip-break assembly 35 comprising means for pivoting the bracket members 54 about a pivot point C, as will be further described. In the preferred embodiment, this is accomplished by raising bracket members 54 that support the holding bar 52. The bracket members 54 are pivotally attached at their proximal ends to the housing 12 so that when the bracket members 54 are lifted at a distal end thereof proximate the holding bar 52 and chip-break shoes 50, the bracket members 54 rotate about the pivot point shown as C on FIGS. 2 and 3, thereby lifting the chip-break shoes above the pass line B. This places the chip-break assembly 35 in a disengaged position as shown on FIG. 3. Lifting the distal end of the bracket members 54 is accomplished by activating an air operated cylinder 56 or similar actuator, which is positioned vertically in the preferred embodiment, having a vertical piston rod 58 fixedly connected at its distal end to the bracket members 54. With the chip-break assembly 35 in an engaged position as shown in FIG. 2, the vertical piston rod 58 is in an extended position. This is the sanding and planing configuration of the machine 10. In contrast, FIG. 3 shows the chip-break assembly 35 in the disengaged position, wherein the vertical piston rod 58 is in a retracted position. The movement of the vertical piston rod 58 from an extended to retracted position causes the upward movement of the chip-break shoes 50 so that the lowermost end of the chip-break shoes 50 are positioned above the pass line B. This is the sanding-only configuration of the machine 10.

The present invention further comprises an electrical control means, not shown, having at least one switch that allows for the concomitant operation of the means for automatically raising the lowermost portion of the antikickback assembly 34 above the passline B, the means for automatically lifting the lowermost portion of the chip-break assembly 35 above the passline B, and means for automatically disabling the motive force to the driven planer head 20. The electrical control means allows the machine 10 to be readily switched from a planing and sanding configuration to a sanding-only configuration, allowing a workpiece 12 to be finished by the sanding assembly 24 without also being sized by the planer head 20.

It is to be understood that the form of the invention shown is a preferred embodiment thereof and that various changes and modifications may be made therein without departing from the spirit of the invention or scope as defined in the following claims.

What is claimed is:

1. An apparatus for sizing and sanding a workpiece, comprising:

a housing having a horizontally throughgoing passage, a feed conveyor for advancing said workpiece through said passage, said workpiece having an upper surface that advances through said passage along a pass line, a sanding station for finishing said upper surface, a planing station for sizing said workpiece along said upper surface, said planing station having a driven planer head, an antikickback assembly, a chip-break assembly, and means for disengaging said planing station to convert said apparatus from a planing and sanding configuration to a sanding-only configuration.

2. An apparatus as described in claim 1 wherein said means for disengaging comprises means for automatically raising a lowermost portion of said antikickback assembly above said passline.

3. An apparatus as described in claim 2 wherein said means for disengaging further comprises means for automatically lifting a lowermost portion of said chip-break assembly above said passline.

4. An apparatus as described in claim 3 wherein said means for disengaging further comprises means for automatically disabling a motive force to said driven planer head.

5. An apparatus as described in claim 4, wherein said apparatus further comprises an electrical control means having a switch that causes the concomitant operation of said means for raising, said means for lifting, and said means for disabling.

6. An apparatus as described in claim 1 wherein said antikickback assembly comprises a plurality of antikickback fingers rotatably mounted to a horizontal positioning rod affixed at its ends to said housing, said antikickback fingers having a distal end terminating in a pointed edge.

7. An apparatus as described in claim 6 wherein each said antikickback finger has a rearward edge resting against a horizontal cam shaft assembly rotatably mounted to said housing, said cam shaft assembly having a longitudinal axis.

8. An apparatus as described in claim 7 wherein said means for automatically raising comprises means for rotating said cam shaft assembly about its longitudinal axis.

9. An apparatus as described in claim 8 wherein said cam shaft assembly comprises a primary cylindrical shaft and a cam lobe along its length, each said rearward edge resting against said primary shaft with said apparatus in said planing and sanding configuration, and each said rearward edge resting against said cam lobe with said apparatus in said sanding-only configuration.

10. An apparatus as described in claim 9 wherein said means for rotating comprises an actuator operatively connected at its distal end to a link member attached to said primary shaft of said cam assembly, said actuator being positionable between an extended position wherein the lowermost portion of said antikickback assembly is positioned below said pass line to a retracted position wherein the lowermost portion of said antikickback assembly is positioned above said pass line.

11. An apparatus as described in claim 1 wherein said chip-break assembly comprises a plurality of chip-break shoes extending from a horizontal holding bar mounted at its ends to a pair of bracket members pivotally connected to said housing.

12. An apparatus as described in claim 11 wherein said chip-break shoes are positioned in close side-by-side relationship to form a row of shoes having an essentially continuous upper, lower, and side surfaces, said shoes extending below and forward said holding bar.

13. An apparatus as described in claim 12 wherein a terminal end of said shoes form a sharp edge at its forwardmost portion.

14. An apparatus as described in claim 11 wherein said bracket members are pivotally attached at a proximal end thereof about a pivot point to said housing, and said means for automatically lifting comprises means for pivoting said bracket members about said pivot point.

15. An apparatus as described in claim 14 wherein said means for pivoting comprises an actuator operatively connected at its distal end to a distal end of said bracket, said actuator being positionable between an extended position wherein the lowermost portion of said chip-break assembly is positioned below said pass line to a retracted position wherein the lowermost portion of said antikickback assembly is positioned above said pass line.

16. An apparatus for sizing and sanding a workpiece, comprising:

a housing having a horizontally throughgoing passage, conveyor means for supporting and advancing said workpiece in a feed direction through said passage, a sanding station for finishing an upper surface of said workpiece as said workpiece advances through said passage, a planing station for sizing said workpiece along said upper surface as said workpiece advances through said passage, said planing station having an antikickback assembly, and positioning means for automatically moving said antikickback assembly from an engaged position wherein at least a portion of said antikickback assembly contacts said upper surface as said workpiece advances through said machine to a disengaged position wherein said assembly does not contact said upper surface as said workpiece advances through said machine.

17. An apparatus as described in claim 16 wherein said antikickback assembly comprises a plurality of antikickback fingers rotatably mounted to a horizontal positioning rod affixed at its ends to said housing, said fingers having a distal end terminating in an pointed edge.

18. An apparatus as described in claim 17 wherein each said antikickback finger has a rearward edge resting against a horizontal cam shaft assembly rotatably mounted to said housing, said cam shaft assembly having a longitudinal axis.

19. An apparatus as described in claim 18 wherein said positioning means comprises means for rotating said cam shaft assembly about its longitudinal axis.

20. An apparatus as described in claim 19 wherein said cam shaft assembly comprises a primary cylindrical shaft and a cam lobe extending along its length, said rearward edge resting against said primary shaft with said antikickback assembly in said engaged position, and said rearward edge resting against said cam lobe with said antikickback assembly in said disengaged position.

21. An apparatus as described in claim 20 wherein said means for rotating comprises an actuator operatively connected at its distal end to a link member attached to said primary shaft of said cam assembly, said actuator being positionable between an extended position wherein said antikickback assembly is in an engaged position to a retracted position wherein said antikickback assembly is in a disengaged position.

22. An apparatus for sizing and sanding a workpiece, comprising:

a housing having a horizontally throughgoing passage, conveyor means for supporting and advancing said workpiece in a feed direction through said passage, a sanding station for finishing an upper surface of said workpiece as said workpiece advances through said passage, a planing station for sizing said workpiece along said upper surface as said workpiece advances through said passage, said planing station having chip-break assembly, and positioning means for automatically moving said chip-break assembly from an engaged position wherein at least a portion of said assembly contacts said upper surface as said workpiece advances through said machine to a disengaged position wherein said assembly does not contact said upper surface as said workpiece advances through said machine.

23. An apparatus as described in claim 22 wherein said chip-break assembly comprises a plurality of chip-break shoes extending from a horizontal holding bar mounted at its ends to a pair of bracket members connected to said housing.

24. An apparatus as described in claim 23 wherein said chip-break shoes are positioned in close side-by-side relationship to form a row of shoes having an essentially continuous upper, lower, and side surfaces, said shoes extending below and forward said holding bar.

25. An apparatus as described in claim 24 wherein the terminal end of said shoes form a sharp edge at its forwardmost portion.

26. An apparatus as described in claim 25 wherein said bracket members are pivotally attached at a proximal end thereof about a pivot point to said housing, and said positioning means comprises means for pivoting said bracket members about said pivot point.

27. An apparatus as described in claim 26 wherein said means for pivoting comprises actuator operatively connected at its distal end to a distal end of said bracket, said actuator being positionable between an extended position wherein a lowermost portion of said chip-break assembly is below said pass line to a retracted position wherein the lowermost portion of said antikickback assembly is above said pass line.

* * * * *